US005431321A

United States Patent [19]

Link et al.

[11] Patent Number: 5,431,321

[45] Date of Patent: Jul. 11, 1995

[54] ROLL FOR WEB PRESSING OR WEB GUIDING

[75] Inventors: Christoph Link, Weingarten, Germany; Rolf Lehmann, Rudolfstetten, Switzerland

[73] Assignee: Sulzer Escher Wyss GmbH, Ravensburg, Germany

[21] Appl. No.: 307,086

[22] Filed: Sep. 16, 1994

Related U.S. Application Data

[63] Continuation of Ser. No. 108,017, Aug. 17, 1993, abandoned.

[30] Foreign Application Priority Data

Sep. 28, 1992 [CH] Switzerland ..... 03025/92
Oct. 7, 1992 [CH] Switzerland ..... 03127/92

[51] Int. Cl.[6] ..... B65H 20/00; F16C 23/00

[52] U.S. Cl. ..... 226/194; 226/190; 384/256

[58] Field of Search ..... 226/190, 192, 193, 194; 384/100, 256; 242/615.4

[56] References Cited

U.S. PATENT DOCUMENTS

| | | | |
|---|---|---|---|
| 1,563,704 | 12/1925 | Greirs | 226/193 X |
| 2,555,319 | 6/1951 | Cross | 226/190 X |
| 2,631,384 | 3/1953 | Offen | 226/190 X |
| 3,737,091 | 6/1973 | Barta et al. | 226/193 |
| 3,802,044 | 4/1974 | Spillmann et al. | 492/5 |
| 4,426,757 | 1/1984 | Hourticolon et al. | 226/193 |
| 4,514,161 | 4/1985 | Winter | 384/256 X |
| 4,553,186 | 11/1985 | Kawakami et al. | 226/193 X |
| 4,721,154 | 1/1988 | Christ et al. | 164/452 |
| 4,926,757 | 5/1990 | Hourticolon et al. | 226/193 |
| 4,964,203 | 10/1990 | Lioy et al. | 226/193 |
| 5,127,141 | 7/1992 | Roerig et al. | 384/256 X |
| 5,188,273 | 2/1993 | Schmoock | 226/190 |

*Primary Examiner*—Daniel P. Stodola
*Assistant Examiner*—Michael R. Mansen
*Attorney, Agent, or Firm*—Townsend and Townsend Khourie and Crew

[57] ABSTRACT

The press guide roll (15) or web guide roll (4) comprises a fiber-reinforced plastic roll tube (20; 6) and a wire layer (7) wound on the surface of the roll tube (20; 6) in order to form substantially peripherally directed grooves (17). On either side of the roll middle (M), complementary sections (*7b, 7c*) of the windings (7) are inclined slightly relative to the peripheral direction and thus form a wire layer which is mirror symmetrically disposed about the roll's middle plane (M). The web guide roll (4) therefore laterally guides and automatically centers the material web.

10 Claims, 1 Drawing Sheet

ROLL FOR WEB PRESSING OR WEB GUIDING

This is a continuation of application Ser. No. 08/108/017, filed Aug. 17, 1993, now abandoned.

FIELD OF INVENTION

The invention relates to a press guide roll or web guide roll comprising a rotatable roll tube, the outer surface of which being provided with grooves having directional components substantially in the peripheral direction.

BACKGROUND OF THE INVENTION

Web guide rolls serve to conduct a material web, for instance of paper, cardboard, plastic, metal, textile or similar, optionally with controllable or regulatable tension, from one place in a mechanical plant to the next where further processing of the material web is to be undertaken, for instance by pressing, stamping, printing, rolling, smoothing, dewatering, coating, coiling or similar.

The exact transfer of the material web by means of the web guide roll is problematic, especially for high web speeds, since an air cushion forms between the outer surface of the web guide roll and the material web, the material web then begins to float on this air cushion and performs uncontrolled movements in the lateral direction so that lateral guidance of the material web is no longer achieved.

In order to remedy this problem, position measuring devices for the edges of the web and regulation devices for the positional displacement of the web guide rolls are provided, for instance in accordance with DE 25 40 923 or DE 39 13 601. These are not only involved and complicated but also function with a certain time lag so that the speed of the web is thus upwardly limited.

In order to avoid this, it was proposed to use a lathe or mill to machine peripheral grooves into the outer surface of a tubular steel or aluminium roll, which, when suitably dimensioned (for instance with a depth of several tenths of millimetres), provides good guidance of the material web and prevents lateral divergence, even for higher web or roll rotational speeds. However, the high mass forces of such rolls are disturbing.

Press rolls serve for the dewatering of fiber webs and are mainly provided with peripheral grooves. When realised as a metal roll, mass and related oscillation problems also occur. These oscillations can be substantially responsible for a shortening of the life of the dewatering felt also fed through the press gap.

To avoid such high mass forces it was proposed to manufacture the roll tube from a lighter material, for instance from a fiber-reinforced plastic which has, however, only a low surface hardness. Therefore, as a result of abrasion of the grooves, rapid wear occurs so that the operational life of such web guide rolls is often inadequate.

SUMMARY OF THE INVENTION

The object of the present invention is to avoid the disadvantages of the prior art discussed above and to create a press guide roll or web guide roll which has a lower mass, better wear and lower wear of the roll surface even for higher web speeds, wherein, for the embodiment as a web guide roll, this allows for an automatic guidance of the material web, even for higher web speeds and rotational speeds, while avoiding a lateral divergence of the material web but without involved and complicated measurement devices and regulation devices being necessary.

The object is satisfied in a press guide roll or web guide roll of the initially named kind in that the grooves are formed by a material wound in at least one layer on the outer surface of the roll tube, the material having a better durability and/or strength than that of the roll tube.

Better oscillation properties, above all for press rolls, are achieved by using a plastic roll tube as a result of their better damping.

The wound-on layer is advantageously made from a wire or metal belt, from fiber-reinforced plastic or from another suitable material with good resistance to abrasion.

The cross-section of the wound-on wire can be chosen to be circular, elliptic, rectangular, quadratic, triangular or similar. It is however of particular advantage to machine the outer surfaces of the outer layer so that a cylindrical surface comprising grooves is formed between the windings. For certain material webs it is however also advantageous to have an outer form comprising wavy grooves such as can be achieved by winding a waved belt on.

For certain applications, in particular press roll ones, it is advantageous to provide the windings as exactly as possible in the peripheral direction. In order to achieve an automatic lateral guidance of the material web with a web guide roll, i.e. an automatic centering towards the roll middle, it is however of particular advantage to arrange the winding on both sides of the roll middle with a certain inclination relative to the peripheral direction wherein the inclination on the one side is opposite to the inclination on the other side so that the windings are mirror symmetric with respect to the roll middle.

In the manufacture of the layer, it is advantageous when the winding of the layer is performed when the surface of the plastic roll tube is not quite set so that the winding is partially embedded in the plastic surface. For this, a prior conditioning of the material to be used for the winding is expedient by which a reliable grip on the plastic of the roll tube is achieved.

If the plastic tube is too flexible, it is recommended to support the tube from inside during the manufacture of the wound layer with the aid of air or liquid bearings.

In particular, if sets of metal rings are used, it is possible to exploit the different thermal expansivities of the metal rings relative to the plastic roll tube by sliding the rings onto the roll jacket at a favorable temperature which subsequently yields an adequate gripping tension between the rings and the plastic roll tube over the range of working temperatures.

In order to achieve an individual adjustability of the tension of the material web, or alternatively an adequate press force, over the width of the roll, it is advantageous to realise the press guide roll or web guide roll comprising a non-rotatable carrier and a roll tube rotatable thereabout which is displaceable relative to the carrier and which is supported with controllable or regulatable supporting force by supporting elements. A virtually friction-free running of the roll tube can be achieved using hydrostatic supporting elements which run on the smooth inner surface of the roll tube by means of hydrostatic bearing surfaces and are supported relative to the carrier by a pressure volume having a liquid or gaseous pressure fluid and being of controllable or regulatable pressure, in a manner analogous to the roll described in U.S. Pat. No. 3,802,044.

BRIEF DESCRIPTION OF THE DRAWINGS

Other objects, features, and advantages of this invention will become more apparent after referring to the following specification and attached drawings in which.

DESCRIPTION OF PREFERRED EMBODIMENTS

Figure 1:
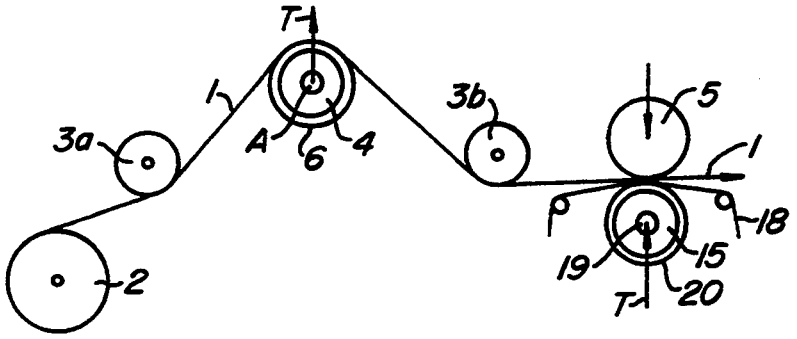
FIG. 1 is a side elevation schematic of a web path utilizing the examples of a web guide roll and a web press roll in the invention herein.

In the arrangement reproduced in FIG. 1, a material web 1 is guided from an initial roll 2 over a deflection roller 3*a* to a web guide roll 4 which centers the material web 1 and is supplied with a certain mechanical pre-tension T over a further deflection roll 3*b* to a roll arrangement 5,15 where the material web is subject to a press processing. In addition to the material web 1, a dewatering felt 18 is also fed through the press gap which is formed by a press roll 15 in accordance with the invention and a hard roll 5, for instance a granite roll.

On weight grounds, the press guide roll 15 and the web guide roll 4 are made from a light roll tube 20 and 6 respectively rotatable about an axis 19 and A respectively, the roll tube being made of, for instance, plastic or light metal. This roll tube 20 and 6 is advantageously wound layer-wise from glass-fiber-reinforced or carbon-fiber-reinforced artificial resin which provides adequate strength even for thin wall thicknesses.

Figure 4A:
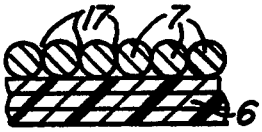
FIGS. 4*a*–4*n* are respective sections taken through a roll, including the outer surface of the roll, illustrating the various configurations of the plastic roller and windings on the roll; and, FIG. 5 illustrates the cross-section of a press guide roll or web guide roll having an interior mechanism for providing reinforcement of the roll from inside the roller.
Figure 4B:
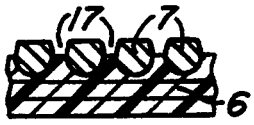
Figure 4C:
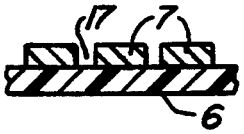
Figure 4D:
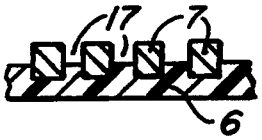
Figure 4E:
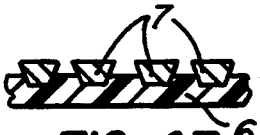
Figure 4F:
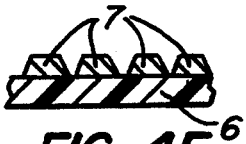
Figure 4G:
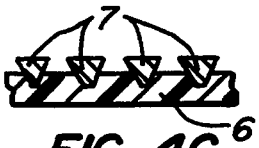
Figure 4H:
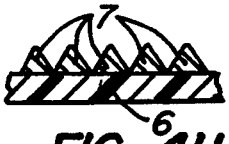
Figure 4I:
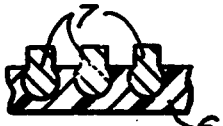
Figure 4J:
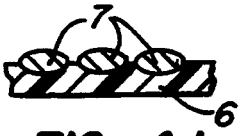
Figure 4K:
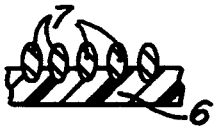
Figure 4L:
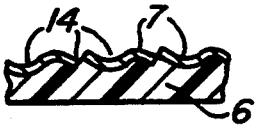
Figure 4M:
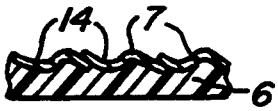
Figure 4N:
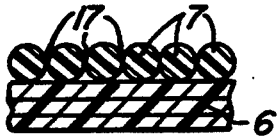

In order to protect the relatively soft surface of the plastic guide tube 20 and 6 from too rapid abrasion and wear, a layer 7 made of a material with better strength than the roll tube 20 and 6 is wound around the outer surface of the roll tube 20 and 6 respectively, with advantage from a wire or belt made from a suitable metal, for instance steel, or also from a fiber-reinforced plastic See FIG. 4N. A single wire or belt winding is, as a rule, sufficient to achieve an improved resistance to abrasion, however a plurality of wire or belt layers can also be wound ontop of one another.

Figure 2:
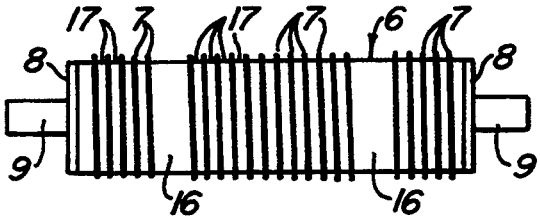
FIG. 2 is an end elevation view of a web guide roll having the outer surface prepared in accordance with this invention.

In the example of FIG. 2, the wire winding 7 is almost peripherally oriented. Here, the wire winding 7 can extend in the axial direction over the entire surface of the roll tube 20 or 6, in particular for use as a press roll, or can be provided for certain applications only over a part of the outer surface of the roll tube 6, i.e. gaps 16 may be present between the individual parts of the winding.

In many cases an adequate axial guidance of the material web 1 can be achieved for web guide rolls 4 having a peripherally oriented winding 7 and grooves 17 so that further lateral divergence can be prevented without having to provide positional measurement devices for the web edges. It is however of especial advantage to orientate the wire or belt winding 7 over the surface of the roll tube 6 in such a way that the material web is automatically centered, i.e. is automatically guided back to the middle when lateral divergence occurs.

Figure 3:
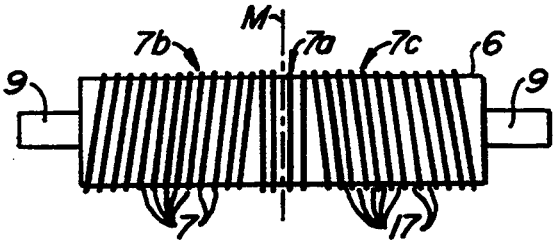
FIG. 3 is an end elevation view similar to FIG. 2 illustrating alternate windings around the roll.
Figure 5:
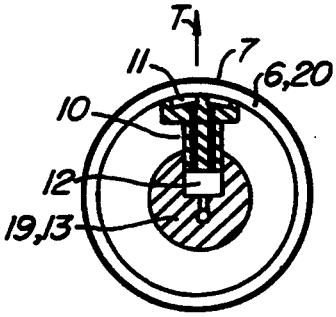

In the example shown in FIG. 3, this is achieved in that, although the middle part 7*a* of the wire winding is oriented peripherally, the windings 7*b* and 7*c* on both sides of the middle M are inclined at an acute angle relative to the peripheral direction and moreover in an opposite sense on the one side 7*b* to on the other side 7*c*. The winding as a whole is thus constructed mirror symmetrically with reference to the mid-plane M of the roll tube. In this manner, a guiding back of the material web to the roll middle can be achieved as soon as it tries to break out sideways along the axial direction.

The cross-section of the material to be wound on can be chosen differently and be tailored to the material web to be transported by the web guide roll. FIG. 4 shows various suitable variants wherein the press rolls 15 preferably have smooth surfaces in order to form a cylindrical roll shape with grooves.

In accordance with FIG. 4A, a wire layer 7 of metal wire of circular cross-section is wound onto the roll tube 6. Flutes 17 are thereby formed between the neighboring wire windings.

In accordance with FIG. 4B, the wire winding 7 is embedded somewhat into the soft surface of the roll tube 6 which is not quite set. Here, it is advantageous to condition the surface of the wire prior to embedding to achieve an improved grip between the wire windings 7 and the wire tube 6. The outer surface of the wire winding 7 is ground and/or polished so that a smoother surface is formed than in the previous example but wherein, however, grooves 17 are still present between the neighboring windings.

In accordance with FIGS. 4C and D, the cross-section of the wire 7 can also be constructed to be rectangular or quadratic, whereby various surface profiles can be achieved depending on the specific requirements. Various trapezoidal, triangular, oval, elliptical or irregular cross-sections of the wire, such as those shown in FIGS. 4E to 4K, can be of advantage, depending on the conditions and the web material to be transported.

Instead of wire, suitable belt-shaped material can be used for the production of the winding. As is shown in FIG. 4L, the wound-on belt 7 can also be wavy, whereby wave-shaped grooves 14 running in the peripheral direction are formed on the surface.

As is shown in FIG. 4M, neighboring belt windings 7 can overlap in the manner of roofing tiles which protects the surface of the roll tube 6 especially well from abrasive and corrosive influences.

The mechanical strength and durability and the resistance to corrosion of the material used for the wound-on wire or belt 7 should be chosen with regard to both the press forces and the material web 1 to be transported. Generally speaking, steel, optionally with special alloy additives, is adequate, however, in particular cases, the use of hard metal or glass-metal is of advantage, for instance in accordance with U.S. Pat. No. 4,721,154.

In a simple embodiment, the roll tube 6 of the web guide roll can be provided with side cover plates 8 which carry the roll spigots 9. The roll tube 6 rotates here together with the cover plates 8 and the spigots 9.

In order to produce an individually controllable mechanical pre-tension or an adequate press force in the transported material web 1 over the width of the roll, it is however of advantage to implement the roll tube 20 and 6 so as to be rotatable about a non-rotatable carrier 19 and 13 respectively and to displaceably support the roll tube 20 and 6 relative to this carrier 19 and 13 respectively with a row of supporting elements 10 arranged next to one another in the axial direction and having adjustable supporting force in the supporting direction T. A virtually friction-free running of the roll tube 20 and 6 can be achieved with hydrostatic supporting elements 10 which run on the smooth inner surface of the roll tube 20 and 6 respectively by means of hydrostatic bearing surfaces 11 and are supported displaceably in the support direction relative to the carrier 19 and 13 respectively which contain a pressure volume 12 which is supplied with a liquid or gaseous pressure fluid and is of controllable or regulatable pressure and which enables a controllable or regulatable supporting force of the supporting elements 10 to be produced relative to the roll tube 20 and 6 respectively.

What is claimed is:

1. A guide roll comprising:

a rotatable roll tube having an outer surface which is provided with grooves having directional components substantially in a peripheral direction and being formed by a material wound in at least one helical layer on the outer surface of the roll tube to form helical windings on said roll tube with said grooves defined between said helical windings, said material wound in at least one helical layer having a greater resistance to abrasion and wear than the material of said roll tube; and, said at least one helical layer defining a helical outer surface parallel to said cylindrical surface and raised above said cylindrical surface;

said at least one helical layer being wound on said surface with neighboring windings abutted against each other.

2. A guide roll according to claim 1 comprising:

said material of said at least one layer is selected from a group having good resistance to abrasion including wound-on wire, belt made from a metal, and a fiber-reinforced plastic.

3. A guide roll according to claim 1 comprising:

said roll has a middle with a first side on one side of said middle and a second side on the opposite side of said middle;

said material of said at least one layer comprises windings being disposed on both sides of the roll middle with an inclination relative to the peripheral direction, the inclination on the first side being opposite to the inclination on the second side so that said windings are mirrored symmetrically about the roll middle.

4. A guide roll according to claim 1 comprising:

said material wound in at least one helical layer is partially embedded in the outer surface of the roll tube.

5. A guide roll according to claim 1 comprising:

said rotatable roll tube comprises a non-rotatable carrier with said roll tube rotatable thereabout, said rotatable roll tube displaced relative to the carrier;

supporting elements supporting said non-rotatable carrier with controllable supporting force.

6. A guide roll according to claim 5 comprising:

said supporting elements are hydrostatic supporting elements on the smooth inner surface of the roll tube and are supported relative to said non-rotatable carrier by pressure fluid;

means for introducing said pressure fluid to said supporting elements.

7. A guide roll according to claim 1 comprising:

the roll tube is made of plastic.

8. A guide roll according to claim 7 comprising:

the plastic of the roll tube is made of wound-on layers of glass-fiber-reinforced or carbon-fiber reinforced artificial resin.

9. In the combination of a guide roll including:

a rotatable roll tube having an outer surface which is provided with grooves, the grooves having directional components substantially in a peripheral direction and being formed by a belt-shaped material wound in at least one helical layer on the outer surface of the roll tube, said material having a greater durability than that of the roll tube, the improvement comprising:

said at least one helical layer being wound on said surface with neighboring windings abutted against each other belt-shaped material has a wavy form constituting wave-shaped grooves on the surface of said rotatable roll tube.

10. In the combination of a web guide roll according to claim 9 and further including:

said belt shaped material is wound on said rotatable roll tube with neighboring belt windings overlapping.

* * * * *